US005853540A

United States Patent [19]

Niemoller et al.

[11] Patent Number: 5,853,540

[45] Date of Patent: Dec. 29, 1998

[54] WATER-RESISTANT RECORDING MATERIAL FOR INKJET PRINTING

[75] Inventors: Axel Niemoller; Klaus Gotzen, both of Duren; Manuel Gold, Koblenz, all of Germany

[73] Assignee: SIHL GmbH, Duren, Germany

[21] Appl. No.: 836,376

[22] PCT Filed: Dec. 8, 1995

[86] PCT No.: PCT/EP95/04848

§ 371 Date: Apr. 25, 1997

§ 102(e) Date: Apr. 25, 1997

[87] PCT Pub. No.: WO96/20091

PCT Pub. Date: Jul. 4, 1996

[30] Foreign Application Priority Data

Dec. 24, 1994 [DE] Germany ..... 44 46 551.3

[51] Int. Cl.[6] ..... B41M 5/00; D21H 13/26; D21H 13/24; D21H 13/08

[52] U.S. Cl. ..... 162/135; 162/137; 162/181.7; 162/168.7; 162/168.2; 428/211; 428/341

[58] Field of Search ..... 162/135, 158, 162/137, 181.7, 164.6, 166, 168.2, 164.7, 168.7; 428/195, 211, 341; 347/105, 98

[56] References Cited

U.S. PATENT DOCUMENTS

| | | | |
|---|---|---|---|
| 4,092,457 | 5/1978 | Fujita et al. | 428/341 |
| 4,517,244 | 5/1985 | Kobayashi et al. | 428/342 |
| 4,636,805 | 1/1987 | Toganoh | 346/1.1 |
| 4,944,988 | 7/1990 | Yasuda et al. | 428/195 |
| 4,965,612 | 10/1990 | Sakaki et al. | 346/1.1 |
| 5,213,873 | 5/1993 | Yasuda et al. | 428/195 |
| 5,270,103 | 12/1993 | Oliver et al. | 428/219 |
| 5,541,633 | 7/1996 | Winnik et al. | 347/98 |

FOREIGN PATENT DOCUMENTS

| | | |
|---|---|---|
| 0 423 829 | 4/1991 | European Pat. Off. . |
| 0 524 635 | 1/1993 | European Pat. Off. . |
| 04 074 685 | 3/1992 | Japan . |
| 2213078 | 8/1989 | United Kingdom . |

OTHER PUBLICATIONS

International Search Report Re International Application PCT/EP95/04848, Filed 08 Dec. 1995.

*Primary Examiner*—Stanley S. Silverman
*Assistant Examiner*—Jose A. Fortuna
*Attorney, Agent, or Firm*—Baker & Daniels

[57] ABSTRACT

Water-resistant recording material for the inkjet process using water-based inks, having a substrate paper which, in addition to cellulosic fibres, contains 1–40% fibres and on one side or both sides of which a water-resistant recording layer is arranged. After storage for 24 hours at 23° C. in water, the recording material has over 80% of the tear strength of the dry paper, measured according to DIN 53128. Even after the storage in water, the color difference ΔE, measured according to DIN 6174, of colored areas of the primary colors applied in the inkjet process is less than 10, based on the initial color values.

12 Claims, No Drawings

WATER-RESISTANT RECORDING MATERIAL FOR INKJET PRINTING

BACKGROUND OF THE INVENTION

1. Field of the Invention

The invention relates to a water-resistant recording material for inkjet printing, which has the character of paper and extremely high water resistance of the printed image and of the substrate material for the recording layer.

2. Description of the Related Art

DE-A-30 18 342 A describes a synthetic paper for inkjet printing, which paper, after being printed on in the inkjet printer, is rendered transparent by means of heat in order to obtain multicolour inkjet recordings having high recording density, good colour reproduction and high water resistance. The print which initially appears pale acquires high contrast and water resistance only as a result of subsequent melting. Papers of this type then have the disadvantage of low opacity (high transparency) and that of the additional process step of the thermal aftertreatment.

DE-A-01 64 196 A discloses a recording layer for inkjet processes on a sheet-like base material which also includes papers of synthetic fibres, the layer containing both a cationic polymer and a polyvalent metal salt for fixing aqueous inks. In addition, water-penetrable or water-swellable binders, such as, for example, polyvinyl alcohol, and pigments, such as, for example, calcium carbonate, kaolin and urea/formaldehyde fillers may be present in such a layer. Owing to the choice of the components used (PVA; polyvalent metal salt; cationic polymer), the water resistance of the prints in the inkjet process is relatively low even if the water resistance test described (immersion for one minute in water followed by drying) is described as being positive. The aim of this application was primarily to produce a rapidly drying and stackable (non-offsetting) paper having a brilliant print.

DE-A-43 30 428 describes an inkjet recording sheet on which recordings having good water resistance can be produced. This is achieved using a water-resistant substrate, which may be a plastic film or a synthetic paper. In addition to finely divided porous pigment, the recording layer necessarily contains, as the main component, amphoteric ion latex of cationic colloid quality. DE-A-43 30 428 expressly states that, using conventional binders without this special synthetic polymer latex, the water resistance after printing is insufficient. Regarding the substrate material, it is stated that a synthetic paper of polypropylene, impregnated paper or plastic films are suitable.

JP-A-4-74685 relates generally to a recording material which can be printed on or written on in the moist state or on which copies can be produced in the wet state. The recording layer contains synthetic polymer latex, pigment, crosslinking agent and wax. The substrate material used is a material comprising cellulosic fibres and synthetic polymer fibres, so that the substrate becomes thermoplastic only at 180° C. or at higher temperatures.

For applications outdoors or in continuous contact with water, inkjet papers known to date are not suitable without further process steps, such as lamination with film, since the water resistance of the base papers and of the recording layer are not sufficient. It is precisely for applications such as, for example, building plans, maps, site plans, for example for divers, labels, sign plates and markings that inkjet prints which are mechanically stable and have unlimited colour stability even under the influence of water are required.

SUMMARY OF THE INVENTION

It is therefore the object of the present invention to provide a recording material for inkjet printing, which material is suitable for outdoor use, including underwater use, and resists any kind of influence by humidity or water. Both mechanical strength of the substrate paper under the influence of water and water resistance of the inkjet image are required for this purpose. Furthermore, a brilliant, high-contrast, coloured or black inkjet print having high resolution and very crisp edges is required.

According to the invention, this object is achieved by a water-resistant recording material for the inkjet process using water-based inks, having a substrate paper containing synthetic fibres and having a recording layer or layers which is (are) arranged on one or both main surfaces of the substrate paper, which layer(s) contain(s) highly porous abrasion-resistant pigment and binder and has (have) a basis weight of 10 g/m$^2$ to 50 g/m$^2$, characterized in that the substrate paper contains from 10% by weight to 90% by weight of cellulosic fibres and from 40% by weight to 1% by weight of synthetic fibres and from 50% by weight to 5% by weight of binder, based on the total weight of the substrate paper, and, after storage for 24 hours at 23° C. in water, the recording material has over 80% of the tear strength of the dry paper, measured according to DIN 53128, and the colour difference $\Delta E$, measured according to DIN 6174, of areas of the primary colours applied to the recording layer in the inkjet process is <10, based on the initial colour values.

DESCRIPTION OF THE INVENTION

In addition to the binder or binders, the substrate paper preferably also contains fillers and/or pigments, the binder content being correspondingly reduced as a result of their presence. Suitable pigments are kaolin, barium sulphate, calcium carbonate, calcium sulphate and $TiO_2$. The pigment/filler content may be 2.0% by weight to 30% by weight. The wet strength of the substrate paper can be tailored to the requirements by the concomitant use of crosslinking agents for the binder and/or wet strength agents. Preferred binders are polyvinyl acetate, polyvinyl acetate copolymers, styrene/butadiene copolymers, styrene/butadiene/acrylonitrile terpolymers, styrene/ (meth) acrylate copolymers, (meth)-acrylic polymers, ethylene/ (meth) acrylic acid copolymers, polyvinyl alcohol, carboxymethylcellulose, hydroxymethylcellulose, starch, starch derivatives, casein or mixtures thereof. Such film-forming polymers are commercially available.

For example, melamine/formaldehyde resins or urea/formaldehyde resins may be used as crosslinking agents. The substrate paper is produced on conventional paper machines by known processes and provided with the binder, preferably in the size press and/or by subsequent coating in a conventional coating machine. For example, polyamide fibres, polyester fibres, viscose fibres or mixtures thereof may be present as synthetic fibres in the substrate paper. The basis weight of the substrate paper may be 50 g/m$^2$ to 300 g/M$^2$, preferably 80 g/M$^2$ to 200 g/m$^2$ .

Owing to the low absorptivity of the paper for water-based inks, direct printing by means of an inkjet printer gives a poorly drying and blurred image which is not water resistant. The substrate paper itself has excellent water resistance, which is manifested by a high tear strength in the completely wet state.

A water-resistant recording layer is therefore applied to one side or both sides of this paper. This said recording layer contains binder, pigment(s), preferably dye fixing compositions, and further conventional auxiliaries.

Surprisingly, it was found that the combination of the special paper which contains synthetic fibres with coatings based on highly porous finely divided pigments leads to an abrasion-resistant and extremely water-resistant paper which, even, for example, after storage in water for 24 hours, retains its strength and shows the image information without abrasion, virtually without loss of contrast.

The recording layer applied to the synthetic base paper results in rapid ink absorption and in fixing of the dyes contained in the printing ink. Furthermore, this coating must have excellent adhesion to the base paper, both in the wet and in the dry state. The coating itself must have high cohesion so that mechanical stress due to flexing, pleating, folding or rubbing, both in the wet and in the dry state, does not damage the layer or the printed image.

In order to ensure good absorptivity for water-based inks, porous pigment, in particular silica, is preferably used in the recording layer. Suitable pigments have a surface area (measured according to BET) of over 200 $m^2/g$. Suitable pigments are, for example, precipitated silica particles having a mean particle size of between 1 $\mu$m and 20 $\mu$m, preferably between 4 $\mu$m and 12 $\mu$m, and the abovementioned BET surface area.

Water-soluble, cationic polymers having a high content of quaternary ammonium groups are preferably present in the recording layer in order to fix the ink dyes. Quaternary polyacrylates, polydiallyldimethyl-ammonium chloride, cationically modified polystyrene, cationically modified starch, cationically modified polyvinyl alcohol, quaternary polyethyleneimine, quaternary polyvinylpyridine and copolymers of these compounds with one another or with other nonionic or anionic monomer units are suitable. 0.1 to 1 part of cationic polymer is preferably added per part of porous pigment.

In order to obtain a particularly water-resistant layer, it is expedient to choose for the pigment a binder which can no longer be superficially dissolved by water after the generally water-based coating has dried. Polymer dispersions, such as, for example, vinyl acetate homo- or copolymers, acrylate (co)polymers, styrene/butadiene copolymers, ethylene copolymers or vinyl chloride copolymers have proved suitable for this purpose. In order to ensure the flexibility of the layer and adhesion to the paper, dispersions having a minimum film formation temperature between −20° C. and +50° C., preferably between −10° C. and +20° C., are preferably used. Water-soluble binders, such as, for example, polyvinyl alcohol, polyvinylpyrrolidone, starch or starch derivatives, may also be used. In order further to increase the water resistance, crosslinking agents which react during drying of the layer may be incorporated into the coating solution. Suitable substances are urea/formaldehyde or melamine/formaldehyde resins, aziridines, polyfunctional isocyanates and boric acid (for PVA).

Optical brighteners, wetting agents, further pigments, for example aluminium hydroxides or aluminium oxides, kaolin, calcium carbonate, dyes, adhesion promoters, antifoams, thickeners, dispersants, etc., may also be present as auxiliaries in the layer.

The ink absorption layer is applied to the synthetic paper with the aid of conventional coating processes, for example by roller application and metering by means of an air brush or rotating doctor blade, preferably from aqueous dispersion, and is dried by means of hot air. The coating weight of the dried coating is between 10 and 50 $g/m^2$, preferably 15 to 30 $g/m^2$. This coating weight is necessary in order to permit rapid absorption of the ink liquid into the coating during printing and thus to prevent blurring of the image lines. The coating weight may be varied depending on the printer and amount of ink.

The ink absorption layer of the present invention exhibits excellent adhesion to the synthetic base paper and has good cohesion and flexibility, so that it withstands any mechanical stresses both in the dry and in the wet state. The coating is thus resistant to flexing, folding and abrasion; furthermore, the layer cannot be damaged in the layer adhesion test by means of a self-adhesive tape, similar to the crosshatch test.

The coated paper has high resistance to mechanical stress, i.e. initial tearing and complete tearing of the paper are possible only with the use of great force, both in the dry and in the wet state. In particular, in the completely wet state, the paper has over 80% of the tear strength of the dry paper, measured according to DIN 53128.

The paper according to the present invention can, using commercial inkjet printers, be printed with a high-contrast image which has crisp edges and high resolution and may be coloured in the case of colour printers. The paper absorbs the generally water-based ink rapidly into the coating and is dry and non-smudging shortly after printing. Suitable printers are, for example, printers which operate according to the bubblejet principle or piezoelectric principle, as are available in various versions, for example from the companies Canon, Epson, Hewlett Packard, etc. Both small-format (DIN A3 and A4) and large-format prints, for example rolls for posters, are possible. The inks used in the abovementioned printers contain, as a rule, further auxiliaries, such as, for example, high boilers (glycols, NMP, etc.) and wetting agents, in addition to water and anionic dyes.

The water-soluble anionic dyes of these inks are fixed in the coating by ionic interaction with the cationic fixing agents so strongly that the printed image becomes extremely water-resistant. The printed image is also very resistant to flexing, pleating, folding and scratching, both in the wet and in the dry state, so that the image information has unlimited stability even under extreme environmental conditions. Inks which have high lightfastness even against UV light are preferably chosen for image production. Owing to the fixing of the dyes and the water resistance of the coating itself, the material withstands the action of water even over long periods. Thus, the colour intensity (contrast) of the printed image decreases only slightly, if at all, during storage for 24 hours in water at 23° C. In any case, the colour stability under these conditions is so good that, after this treatment, the colour difference $\Delta E$ of coloured areas of the primary colours black, cyan, magenta, yellow, blue, red and green is less than 10, based on the initial colour values.

Test methods

Tear strength of the wet paper and resistance of the printed image

A test image which contains in particular large coloured areas of all primary colours (cyan, magenta, yellow and black) and of the binary mixed colours (blue, green, red) is applied to the water-resistant inkjet paper by means of an inkjet printer. 10 minutes after production of the test image, the recording sheet is immersed completely in water at 23° C. for 24 hours. After this storage time, the mechanical strength of the paper in the wet state in the longitudinal and transverse directions is determined according to DIN 53128 (tear strength). The tear strength of the dry paper conditioned at 23° C. and 50% relative humidity is also determined.

Furthermore, the paper stored in water for 24 hours is dried in a drying oven at 80° C. for 5 minutes. As was done directly after the test printing, the colour location, in Cielab coordinates, of each coloured area is then determined by means of a calorimeter according to DIN 6174. The colour difference $\Delta E$, calculated from the measurements before and after storage of the particular coloured area in water, is a measure of the discoloration of the printed areas or fixing of the dyes of the inkjet inks.

EXAMPLE 1

A commercial synthetic 140 $g/m^2$ paper consisting of 61% of cellulosic fibres, 4% of synthetic fibres, 12% of synthetic binders and auxiliaries is coated with the following coating composition with a coating weight (dry solids) of 25 g/m$^2$ by means of a rotating doctor blade and is dried in a drying oven at 100° C. for 5 minutes.

| | |
|---|---|
| Water | 600 g |
| Precipitated silica FK 320 DS (Degussa) | 80 g |
| Poly(diallyldimethylammonium) chloride having an average molecular weight of 75,000 | 10 g |
| Vinyl chloride/vinyl acetate copolymer dispersion (50% solids content) | 90 g |
| Wetting agent | 2.5 g |
| Polyvinyl alcohol Mowiol 4/88 (Hoechst), 10% strength solution | 225 g |
| Ammonia (25% solids content) | 7 g |

The paper coated in this manner is printed with a test print by means of a Canon BJC 800 inkjet printer with associated ink cartridges. It has extremely high water resistance: the image-bearing paper stored in water for 24 hours at 23° C. has a tear strength of 3.16N longitudinally and of 3.64N transversely, compared with 1.6N longitudinally and 2.0N transversely in the dry state.

The coloured areas show only very little or no colour changes compared with the initial colour values as a result of the treatment:

| | ΔE |
|---|---|
| Black: | 0.9 |
| Cyan: | 5.0 |
| Magenta: | 6.5 |
| Yellow: | 8.1 |
| Blue: | 1.3 |
| Green: | 2.1 |
| Red: | 4.7 |

After this treatment, the print exhibits a high-contrast, high-resolution image having crisp edges and shows no visible change.

We claim:

1. Water-resistant recording material for an inkjet process using water-based inks, said recording material comprising:

a substrate paper containing from 10% by weight to 90% by weight of cellulosic fibers and from 40% by weight to 1% by weight of synthetic fibers, said synthetic fibers selected from the group consisting of polyamide fibers, polyester fibers, viscose fibers, and mixtures thereof, said substrate paper comprising from 50% by weight to 5% by weight of binder selected from the group consisting of polyvinyl acetate, polyvinyl acetate copolymers, styrene/butadiene copolymers, styrene/butadiene/acrylonitrile terpolymers, styrene/(meth) acrylate copolymers, (meth)acrylic polymers and ethylene/(meth)acrylic acid copolymers, said binder excluding water soluble polymer binders;

at least one recording layer arranged on at least one main surface of the substrate paper said recording layer having a basis weight of 10 g/m$^2$ to 50 g/m$^2$ and containing an abrasion-resistant pigment and a dried residue of an aqueous polymer dispersion as polymeric binder;

said aqueous polymer dispersion having a minimum film formation temperature between −20° C. and +50° C. and, if desired, said recording layer further containing a water soluble binder selected from the group consisting of polyvinyl alcohol, polyvinylpyrrolidone, starch, starch derivatives and a crosslinking agent for the binder; and said recording material after storage for 24 hours at 23° C. in water having over 80% of a tear strength of said recording material before said storage in water, measured according to DIN 53128 and having a colour difference ΔE of less than 10, measured according to DIN 6174, of areas of primary colours applied to the recording layer in an inkjet process, based on initial colour values before said storage in water.

2. The water-resistant recording material of claim 1, wherein the recording layer contains silica as the abrasion-resistant pigment, the silica comprising 10% by weight to 70% by weight, of the total recording layer weight.

3. The water resistant recording material of claim 2, wherein the polymer in said aqueous polymer dispersion having a minimum film formation temperature from −20° C. to +50° C. is selected from the group consisting of polyvinyl acetate, polyvinyl acetate copolymers, styrene/butadiene copolymers, styrene/butadiene/acrylonitrile terpolymers, styrene/(meth)acrylate copolymers, (meth)acrylic polymers, ethylene/(meth)acrylic acid copolymers, ethylene copolymers or vinyl chloride copolymers, vinyl chloride copolymers and mixtures thereof.

4. The water-resistant recording material according to claim 2 wherein the recording material includes a recording ink containing water-soluble dyes.

5. The water-resistant recording material according to claim 3 wherein the recording material includes a recording ink containing water-soluble dyes.

6. The water resistant recording material of claim 1, wherein the polymer in said aqueous polymer dispersion having a minimum film formation temperature from −20° C. to +50° C. is selected from the group consisting of polyvinyl acetate, polyvinyl acetate copolymers, styrene/butadiene copolymers, styrene/butadiene/acrylonitrile terpolymers, styrene/(meth)acrylate copolymers, (meth)acrylic polymers, ethylene/(meth)acrylic acid copolymers, ethylene copolymers or vinyl chloride copolymers, vinyl chloride copolymers and mixtures thereof.

7. The water-resistant recording material according to claim 6 wherein the recording material includes a recording ink containing water-soluble dyes.

8. The water resistant recording material of claim 1, wherein the recording layer further contains a polymeric cationic fixing agent for aqueous inks.

9. The water resistant recording material of claim 8, wherein the polymeric cationic fixing agent is selected from the group consisting of modified polystyrene, a cationic (meth)acrylate copolymer, a quaternary polyimine, poly (diallyldimethylammonium) chloride and a mixture thereof.

10. The water-resistant recording material according to claim 9 wherein the recording material includes a recording ink containing water-soluble dyes.

11. The water-resistant recording material according to claim 8 wherein the recording material includes a recording ink containing water-soluble dyes.

12. The water-resistant recording material according to claim 1 wherein the recording material includes a recording ink containing water-soluble dyes.

* * * * *